US011149327B2

(12) United States Patent
Weinmeister et al.

(10) Patent No.: US 11,149,327 B2
(45) Date of Patent: Oct. 19, 2021

(54) METHOD AND DEVICE FOR HEATING A STEEL BLANK FOR HARDENING PURPOSES

(71) Applicants: voestalpine Automotive Components Cartersville Inc., White, GA (US); Bayerische Motoren Werke Aktiengesellschaft, München (DE)

(72) Inventors: Wilhelm Weinmeister, Dallas, TX (US); Markus Pfestorf, Neufahrn (DE)

(73) Assignees: voestalpine Automotive Components Cartersville Inc., White, GA (US); Bayerische Motoren Werke Aktiengesellschaft, Munich (DE)

( * ) Notice: Subject to any disclaimer, the term of this patent is extended or adjusted under 35 U.S.C. 154(b) by 122 days.

(21) Appl. No.: 16/422,643

(22) Filed: May 24, 2019

(65) Prior Publication Data

US 2020/0370139 A1 Nov. 26, 2020

(51) Int. Cl.
*C21D 9/46* (2006.01)
*C21D 1/76* (2006.01)

(52) U.S. Cl.
CPC ..... *C21D 9/46* (2013.01); *C21D 1/76* (2013.01)

(58) Field of Classification Search
CPC ..... C21D 9/46; C21D 1/76; C21D 1/18
See application file for complete search history.

(56) References Cited

U.S. PATENT DOCUMENTS

| | | | | |
|---|---|---|---|---|
| 9,194,034 | B2 * | 11/2015 | Steins | C21D 9/46 |
| 2013/0309124 | A1 * | 11/2013 | Yamakawa | C22C 38/58 420/38 |
| 2016/0017452 | A1 * | 1/2016 | Puerta Velasquez | C21D 1/34 148/531 |

FOREIGN PATENT DOCUMENTS

| | | | |
|---|---|---|---|
| AT | 008646 | U1 | 10/2006 |
| DE | 102011053634 | B3 | 3/2013 |
| EP | 1658390 | B1 | 9/2014 |
| WO | 2014173494 | A1 | 10/2014 |

* cited by examiner

*Primary Examiner* — Anthony J Zimmer
*Assistant Examiner* — Jacob J Gusewelle

(57) ABSTRACT

A method and a device for heating a sheet metal blank or a formed sheet metal component above the austenitization temperature for the purpose of quench hardening, wherein the dew point of the furnace atmosphere is set to −15° C. to 15° C., preferably to −10° C. to 10° C., in particular for the formation of a loosely adhering oxide skin, for controlling an oxide skin on the sheet metal or component coated with a metallic corrosion protection layer or an uncoated sheet metal or component.

9 Claims, 7 Drawing Sheets

| | L1 | L2 | L3 | L4 | L5 | L6 | L7 | L8 |
|---|---|---|---|---|---|---|---|---|
| l/h | 0 - 100 | 0 - 100 | 0 - 100 | 0 - 100 | 0 - 100 | 0 - 100 | 0 - 100 | 0 - 100 |

| | L1 | L2 | L3 | L4 | L5 | L6 | L7 | L8 |
|---|---|---|---|---|---|---|---|---|
| l/h | 0-100 | 0-100 | 0-100 | 0-100 | 0-100 | 0-100 | 0-100 | 0-100 |

METHOD AND DEVICE FOR HEATING A STEEL BLANK FOR HARDENING PURPOSES

FIELD OF THE INVENTION

The invention relates to a method for heating a steel blank, which is then formed and hardened using a hot forming or press hardening (or quench hardening) process.

BACKGROUND OF THE INVENTION

It is known that structural components of motor vehicle bodies are made of hardened steel components in order to make them particularly stable.

These hardened steel components are produced in two conventional ways: either a flat blank of steel sheet is heated, austenitized and then hot formed and hardened, or a component is cold formed, then heated and then quench hardened and held in a tool which corresponds to its contour.

In both cases, heating for hardening purposes usually takes place in a furnace, wherein the furnace atmosphere influences the surface of the steel to be heated due to the very high temperatures (sometimes above 900° C.), regardless of the heating method used.

Particularly when galvanized blanks are used, an influence is even desired, because an oxide layer should form on the surface of a zinc layer due to small amounts of oxygen-affine elements, which protects the underlying zinc layer.

But even with any other coating or with uncoated sheet metal, oxidation reactions occur on the surface.

Both the iron from the steel and alloy components such as manganese may lead to oxidation reactions on the surface. With coated steels, the coating reacts with the steel and, in addition to the coating components, Fe and the alloying elements of the steel can also lead to oxidation reactions on the surface. In galvanized steels, the alloying elements of the coating oxidize additionally. In particular, oxygen-affine elements such as aluminum form an AlO layer or Al2O3 layer as well as manganese oxide layers or zinc oxide layers or mixed oxides are formed on the surface.

Well-known steels for this quench hardening process are steels alloyed with manganese and boron, which are well known to persons skilled in the art. Here for example the so-called 22MnB5 or the 20MnB8 is to be mentioned.

The oxide layers that form also influence subsequent processes such as welding, bonding and painting.

Optionally, these scale layers or oxide layers must be removed completely or at least partially afterwards. In the case of uncoated steels, an oxide layer also forms even when a protective gas atmosphere is used. The oxide layer in both steel grades mentioned, galvanized and uncoated, is generally removed to a large extent by abrasive blast wheel blasting. Particular care must be taken to ensure that loose oxide particles are removed. However, experience has also shown, particularly with uncoated steels, that even with an oxygen content of less than 2% there is a risk that an oxide layer with very firmly adhering oxides is formed, which can no longer be removed by abrasive blasting. Steel gravel is generally used for blasting. In rare cases, glass beads, sand or the like can also be used as blasting media. When blasting through these abrasive media, however, there is a risk that the component will be deformed and the dimensional accuracy negatively impaired. By optimizing the blast parameters, the distortion of the components can be reduced within narrow limits.

Loosely adhering oxides in the sense of the application are those which—as shown above—can be easily removed by blast cleaning.

From literature also some test procedures for determining "loosely" are known, like for example AT008646U1 which is also known under the name "coilscoop". This allows adhesive tapes to be applied to a tape with a controlled force to determine the extent to which the surface adheres to the substrate. Alternatively, the so-called "Scotch Tape Test" could also be used for this purpose.

The provision of oxygen-affine elements in a zinc layer to form a thin oxide skin is known from EP 1 658 390 B1, for example. The oxide skin formed there can then be removed by a suitable blasting process ($CO_2$ blasting or gravel blasting or centrifugal blasting).

From DE 10 2011 053 634 B3 a method is known for heating a precoated steel blank for the manufacture of a hot formed component, wherein the blank provided with a coating is heated in a furnace, wherein at least regionally an intermetallic alloy layer is formed on the blank, wherein the atmosphere within the furnace is controlled by the supply of pretreated air, wherein the air is pretreated by drying it prior to its supply and, if necessary, heating it. In particular, the dew point should be set to values between −70° C. and +10° C., preferably +30° C. to 0° C., by supplying heated and dried air. The adjustment of the dew point is mainly used to avoid hydrogen embrittlement in AlSi-coated components.

From WO2014/173494 A1, a method for regulating a dew point temperature of a heat treatment furnace is known, in which metallic workpieces in particular are to be treated and in particular pre-treated for a hardening process. In this case, nitrogen and air are to be supplied to a heat treatment furnace and a quantity of supplied nitrogen is to be added, based on an actual dew point temperature value determined in the heat treatment furnace, wherein the actual dew point temperature value is controlled to a target value by the determined amount of supplied nitrogen.

U.S. Pat. No. 9,194,034 B2 also provides a method for heating steel components which are to be subsequently formed, wherein the corresponding heat treatment furnace is to have a controlled atmosphere such that the air which is supplied is dried.

It has been recognized that drying the air alone does not lead to the desired success.

In practice, it has been shown that metal sheets are nevertheless produced or components are produced which have only weak painting capabilities.

It is the object of the invention to create a method for heating a blank made of sheet steel or a component made of sheet steel, with which a surface is produced which can be further processed in an improved manner or at least cleaned as completely as possible by a low blast pressure.

SUMMARY OF THE INVENTION

In accordance with the invention, it was found that simply setting a dew point as low as possible is not sufficient to achieve a surface quality that is uniform and recurrently good.

For example, it was found that with very dry air in the oven, this occurs with a low dew point of approx. −15° C. to 0° C., but nevertheless components with a silvery surface appearance, and that in this case a cathodic dip coating leads to reliable adhesion. In some cases, however, a deterioration in performance with regard to paint infiltration in the event of corrosion was observed. This concerns coated sheets. In the case of uncoated material, it was found that a remaining oxide layer leads to a reduction in the adhesion of adhesive or paint.

According to the invention, it has been possible to ensure an oxide layer on galvanized and uncoated sheet metal which does not necessarily have to undergo further post-treatment, such as cleaning, wherein an improvement in the optical appearance of the steel is achieved and wherein the method can also be carried out simply and inexpensively.

According to the invention, this is achieved by a special dew point control in the furnace, wherein, for example, the movement of a dew point below 5° C. in the furnace process leads to a reduction of the oxide skin without neutralizing its protective effect on the actual zinc coating. The adjustment of a dew point to −5° C. to 5° C., especially −5° C. to 0° C., has proven to be preferred for the formation of the oxide layer.

Surprisingly, it was found that dew point control has little or no effect on the formation of the aluminum oxide layer, but that at a low dew point the formation of the manganese oxide layer as well as the zinc oxide layer (the latter for galvanized blanks) is delayed or suppressed. The inventors suspect that this could also be due to an increased heating rate in the lower temperature range up to 550° C., which heating rate makes a complete conversion of zinc into intermetallic ZnFe phases more difficult. This can correlate with the dew point set accordingly. It was found that with a dew point of less than −10° C. the formation of these layers is significantly delayed, while with a dew point of higher than 0° C. this formation is intensified.

This means that scaling with a protective oxide skin can be specifically adjusted by controlling the atmosphere by regulating the dew point This can also influence the emissivity of the steel strip surface and the associated heating behavior in the furnace. The lower the dew point was selected, the higher the emissivity and the higher the heating rate. In addition, the suitability for welding can also be positively influenced.

In the case of uncoated steels, control is carried out according to the invention in such a way that the scale layer can be removed evenly and without optically visible residues. Due to the improved formation of FeO on the blank which are loosely adhered after conditioning can be easily conducted. In prior art a layer of Fe3O4 and Fe2O3 is more significant on the blank which adheres stronger and this can lead to deteriorated conditioning properties.

In this respect, in accordance with the invention, not only the dew point is adjusted, but also the thickness of the oxide layer on a coating or on an uncoated material. In particular, it turned out in accordance with the invention that dew point control can also be useful over the passage length of the furnace. It can be particularly advantageous for the oxide layer formation if a particularly high amount of dry air is blown into the first third of the furnace, i.e. at the beginning of the heating rate, then the injection quantity decreases and increases again in the last third. It is assumed that the formation of the oxide layer can be decisively influenced at the beginning due to the changed heating behavior, whereas in the middle phase the injection quantity is no longer so relevant. In the last third, i.e. at relatively low heating rates, the zinc layer is again decisively influenced, so a higher injection quantity can be very advantageous for the layer formation. A higher injection quantity in the sense of the invention corresponds to a quantity of 50 to 200 l/h per lance, while a lower quantity can be in the range of 0.5 to 40 l/h per lance.

It has been found that sheets with a silvery surface can usually be less suitable and are sometimes complained about, while greenish sheets have a more suitable oxide skin so that they can be more suitable for most applications.

According to the invention, the dew point can be set to −15° C. to +15° C. and water can also be added.

If the dew point for galvanized steel is set slightly higher, preferably between 0° C. and 10° C., the sheet can exhibit an even distribution of zinc oxide with small proportions of manganese oxides or mixed zinc-manganese oxides (greenish appearance) after leaving the furnace. An even distribution means that the zinc oxide extends over almost the entire surface of the blank or component. An oxide layer with an average thickness of maximum 1 μm is preferably formed, which has an area proportion of at least 50% up to 95% of zinc oxide. The total proportion of manganese oxides and mixed zinc-manganese oxides is less than 50%, preferably less than 10%.

On the other hand, the dew point of galvanized steel can also be set lower, preferably between −10° C. and 0° C. As a result, after leaving the furnace, the sheet can have a smooth coating of aluminum oxides with only small proportions of other oxides and consequently a greyish appearance. Here, too, the average oxide layer thickness is comparatively low, preferably less than 1 μm. Smooth coating in the sense of the invention means that the aluminum oxide extends as far as possible over the entire surface. The surface proportion of aluminum oxide is at least 60%, preferably greater than 70%, particularly preferred greater than 90%.

The dew point control can also be adapted to the respective sheet thickness, e.g. if sheets thinner than 2 mm, e.g. 1 mm, are used, the dew point can be increased by several degrees to achieve the same layer formation or a similar heating curve, since the thinner sheet would heat up more quickly.

A continuous furnace according to the invention has several supply air lances or pairs of supply air lances. Advantageously, the number of such air lances is at least 6 to 12.

Each of these supply air lances can inject dew-point-controlled air, wherein the amount of air per hour can range from 0.5 to 250 l. Preferably the amount of air is from 0.5 to 100 l/h.

In addition, a corresponding measuring point can be provided at or in the immediate vicinity of the supply air lances in order to determine the dew point by means of the measuring point and to be able to readjust it if necessary.

BRIEF DESCRIPTION OF THE DRAWINGS

The invention is explained by reference to examples shown in the drawings, wherein.

DETAILED DESCRIPTION OF THE PREFERRED EMBODIMENTS

Figure 1:
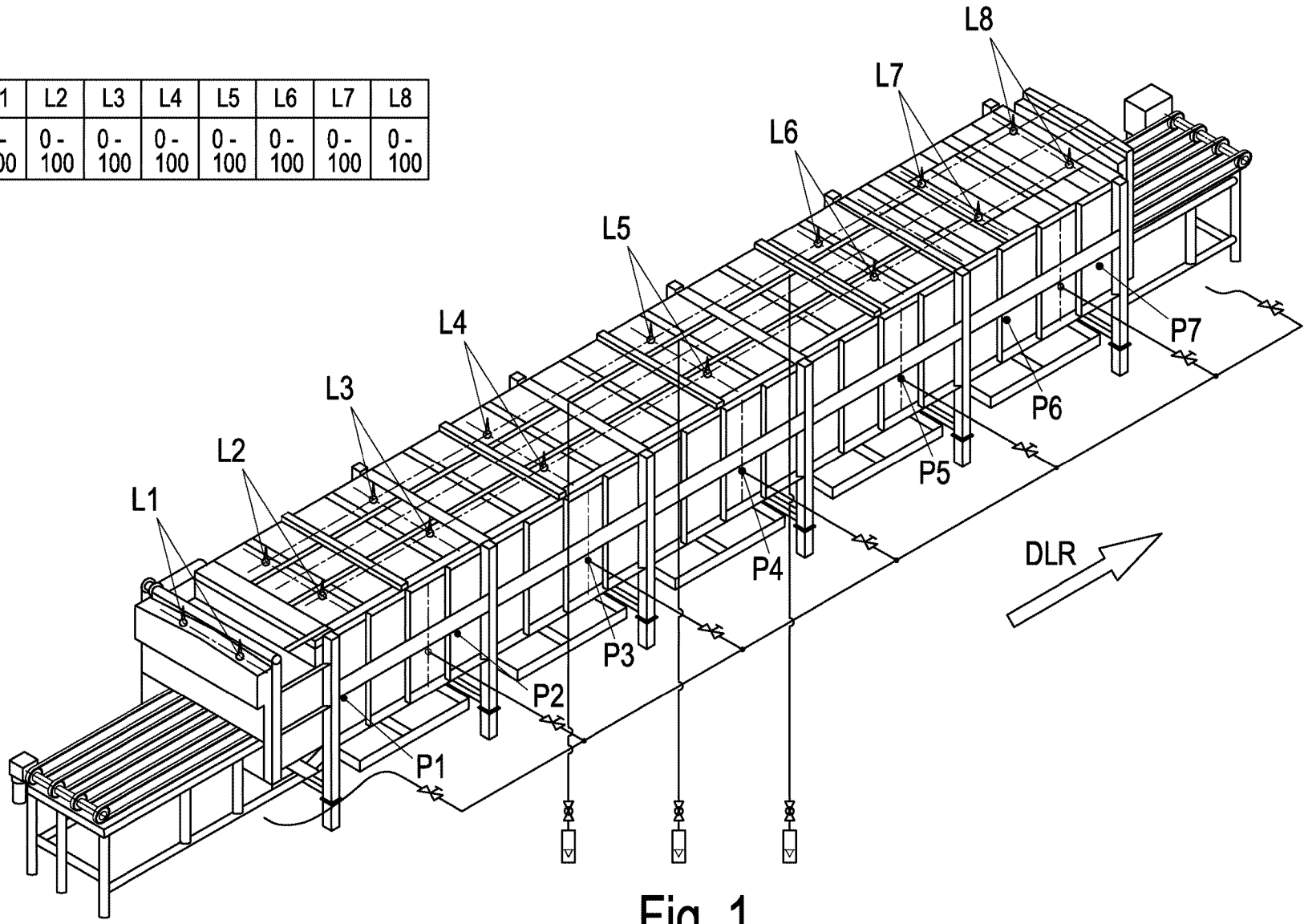
FIG. 1 shows a continuous furnace according to the invention to carry out the method according to the invention.

FIG. 1 shows a pass-through according to the invention for carrying out the method according to claim 1.

8 pairs of supply air lances L1 to L8 are mounted in the furnace, which can introduce different quantities of dried air into the furnace chamber.

In addition, 7 measuring points 1 to 7 are provided, which are intended for measuring the dew point in the furnace.

Based on the measured values (dew point), the supply air can be controlled for the respective supply air lance pair.

DLR refers to the furnace passage direction, hence the direction in which the blanks or components pass through the furnace, i.e. they are introduced into the furnace on the left side, first reach the supply air lance pair L1, L2, etc. and at the end of the continuous furnace reach a temperature above the austenitization temperature of the respective steel sheet grade, i.e. approx. 850° C. to 900° C.

Figure 2A:
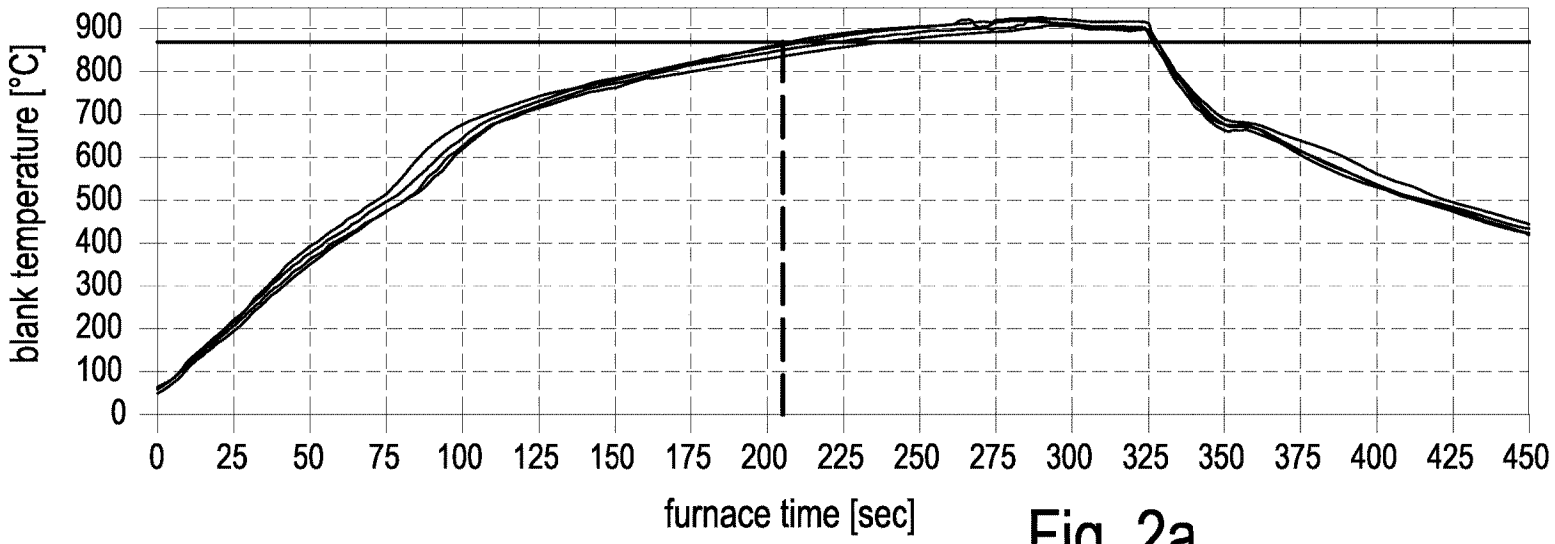
FIG. 2*a* shows a heating curve of a 1.5 mm zinc-alloyed steel plate heated in the method according to the invention with dew point control.

The corresponding heating curve when using the method according to the invention is shown in FIG. 2*a*. It can be seen that the throughput time for heating the 1.5 mm thick galvanized sheet in the continuous furnace to a temperature of over Ac3, i.e. approx. 870° C. with a 22MnB5 alloy, is about 200 seconds due to the dew point control.

Figure 2B:
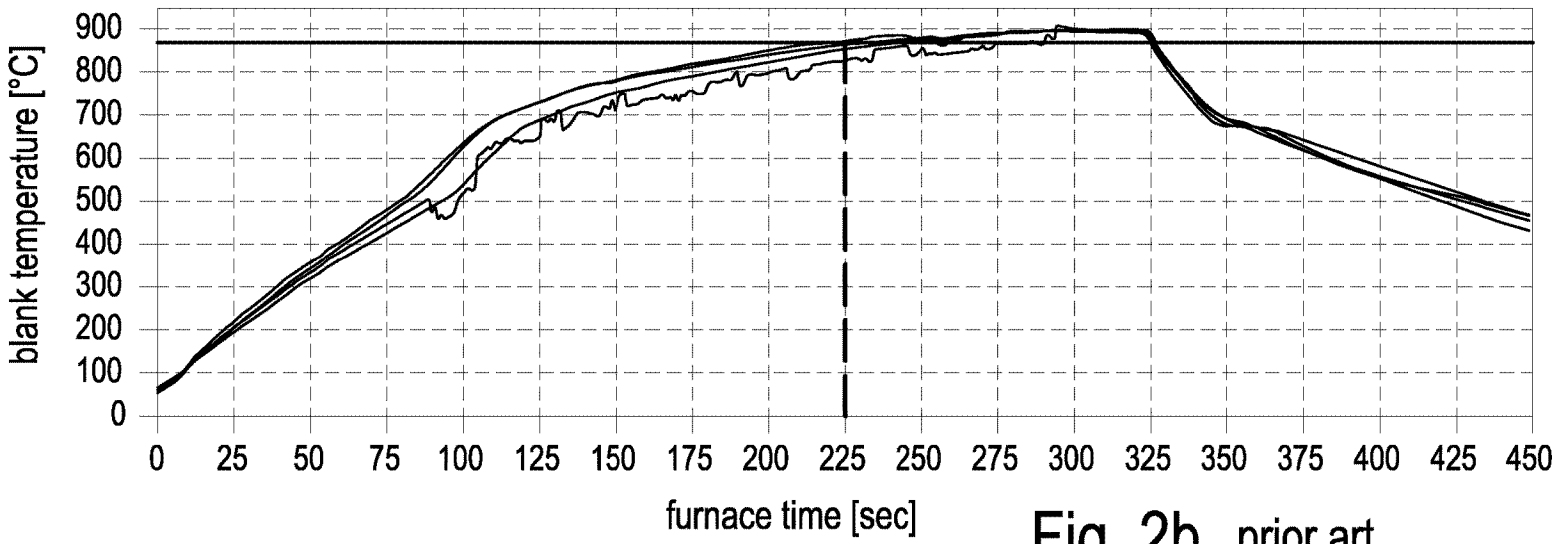
Fig. 2b prior art
FIG. 2*b* shows a heating curve of a 1.5 mm zinc-alloyed steel plate heated in a method without dew point control (prior art)

FIG. 2*b* shows the same heating curve according to the prior art. The only difference to the curve shown in FIG. 2*a* is that the dew point control was not carried out and therefore no corresponding dried air was supplied. The cycle time increased to about 225 seconds in this experiment.

This clearly and directly shows that a higher heating rate can be ensured with the dew point control according to the invention.

Figure 4:
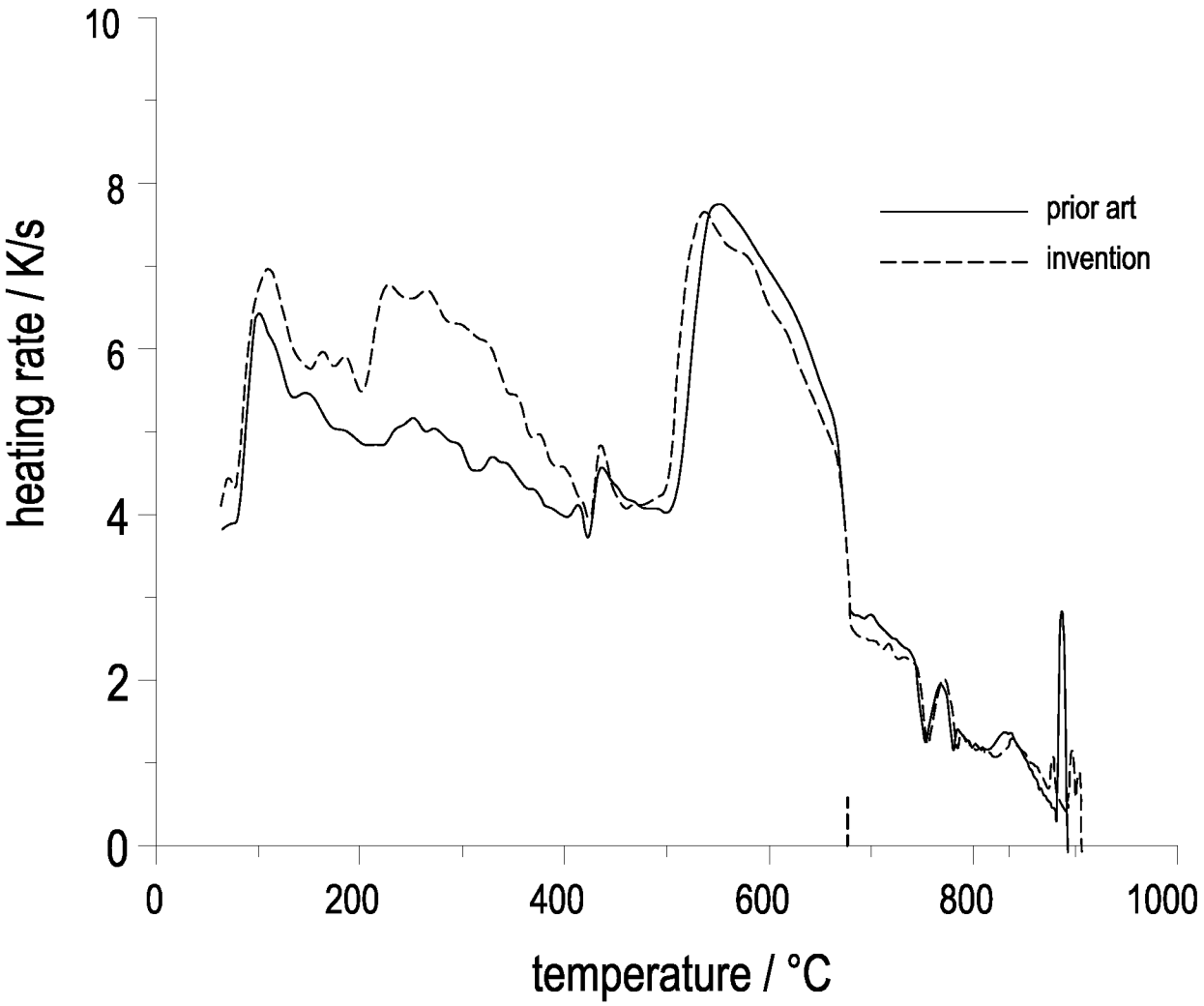
FIG. 4 shows a comparison of the heating rate of a furnace with standard mode according to the prior art with dry mode according to the invention.
Figure 5:
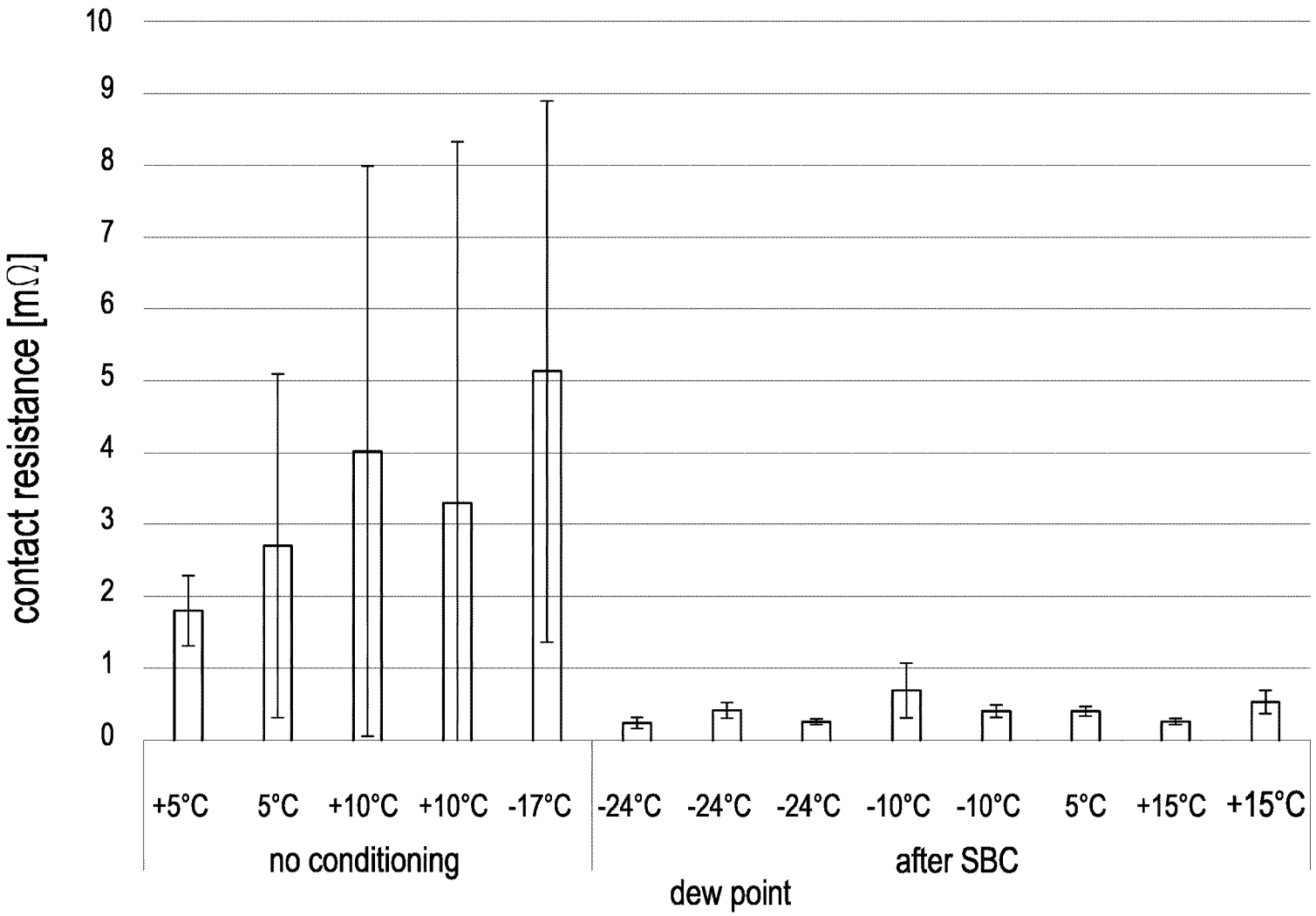
FIG. 5 shows the influence of the dew point on weldability.
Figure 6:
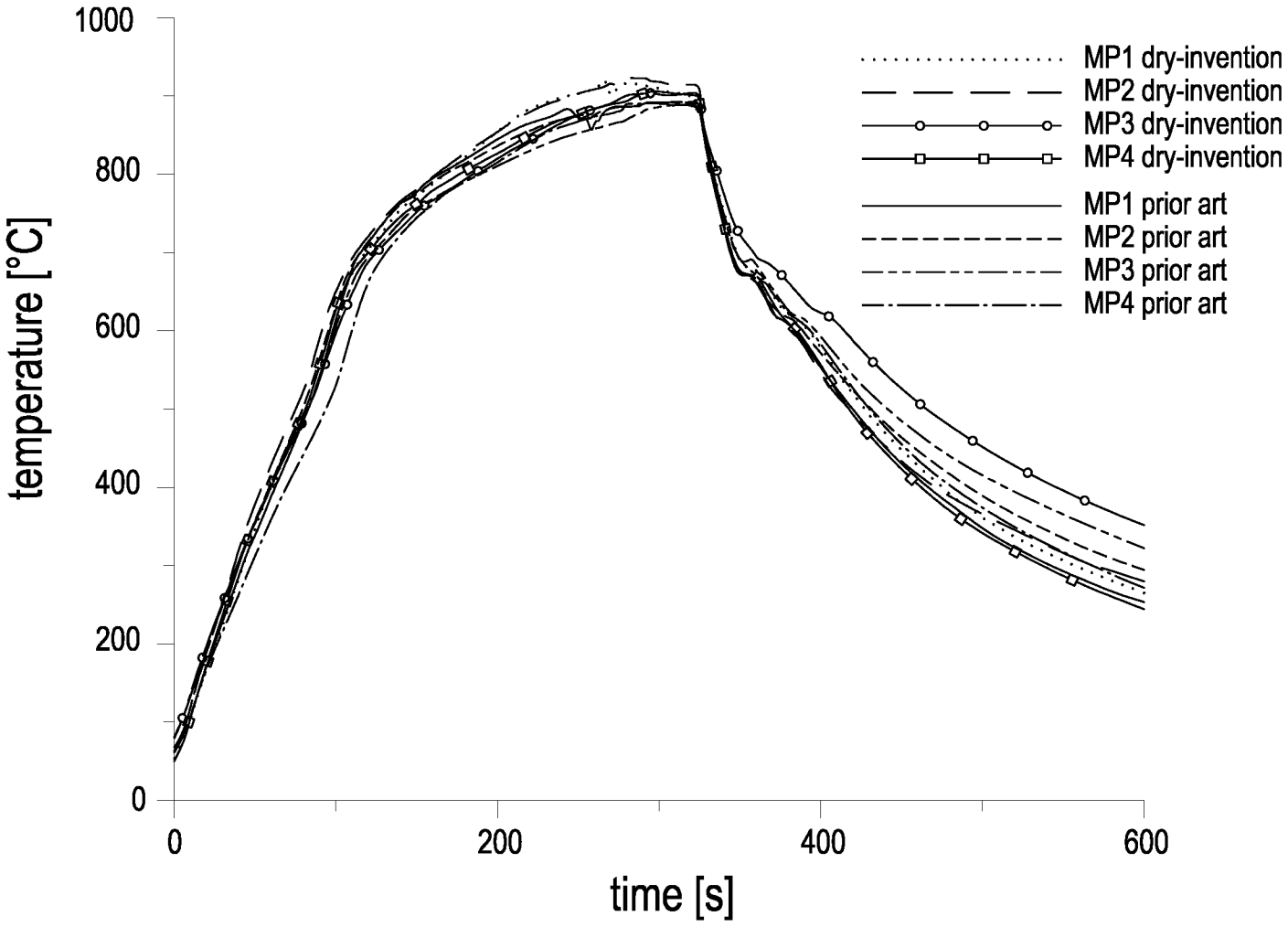
FIG. 6 shows a further comparison of the heating rate of a furnace with standard mode according to the prior art with dry mode according to the invention.

This can also be seen in FIGS. 4 and 6.

FIG. 4 shows the heating rate in K/s—i.e. the acceleration of heating. It becomes apparent that especially at the beginning, i.e. from 100° C. to approx. 400° C., a considerably higher heating rate and thus faster heating can be ensured by the dew-point-controlled dry mode (dashed line) according to the invention.

Also in FIG. 6 this is shown again as a function over time.

Figure 3A:
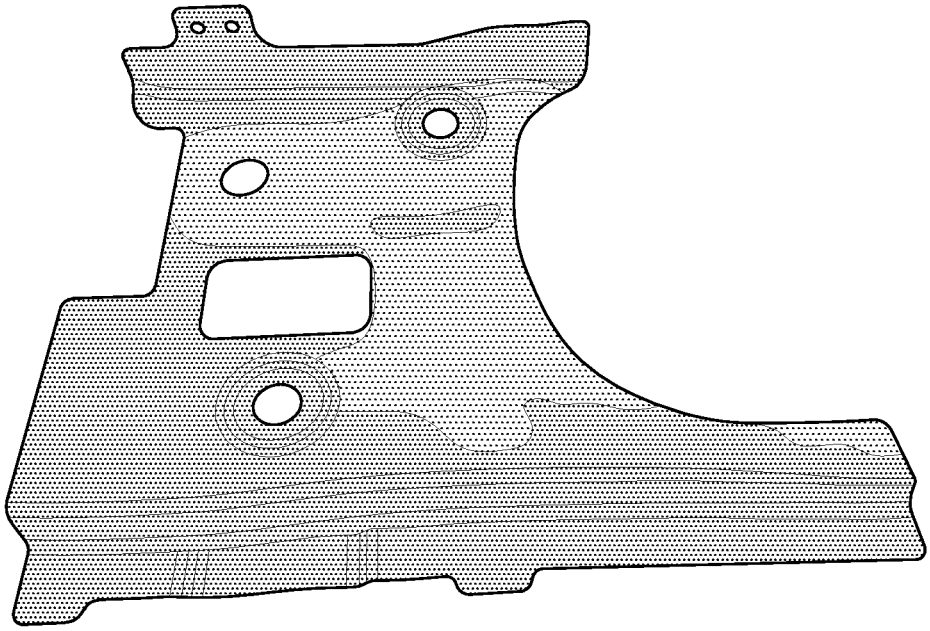
FIG. 3*a* shows a hot-formed, galvanized component heated in the method according to the invention with dew point control.
Figure 3B:
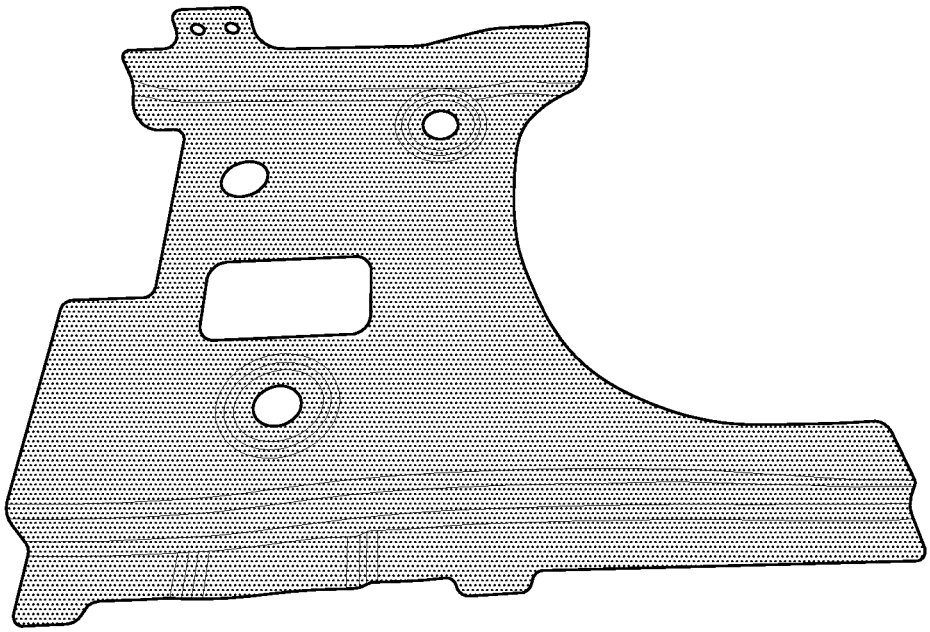
Fig. 3b prior art
FIG. 3*b* shows a hot-formed, galvanized component heated according to a method without dew point control (prior art)

FIG. 3 shows a component manufactured in accordance with the invention and the prior art (in this case a longitudinal beam). It can be seen that the component produced with dried air in the method according to the invention has a much more silvery color and thus an easily removable oxide layer. In contrast, in FIG. 3*b* the prior-art component (with a significantly higher dew point in the furnace atmosphere) shows a greenish/brownish oxide layer.

In addition, the inventors were able to establish that the dew point control did not lead to any deterioration in weldability. The contact resistance for all components after post-conditioning (mostly shot blast cleaning—SBC) is about 0.2 to 0.8 mOhm. These are therefore all judged to be well suitable for welding—a limit value of about 2 mOhm can be assumed for this, below which it should be for good welding suitability.

The method according to the invention can also be used not only to heat uniform components but also to manufacture tailored property parts (TPP).

Figure 7:
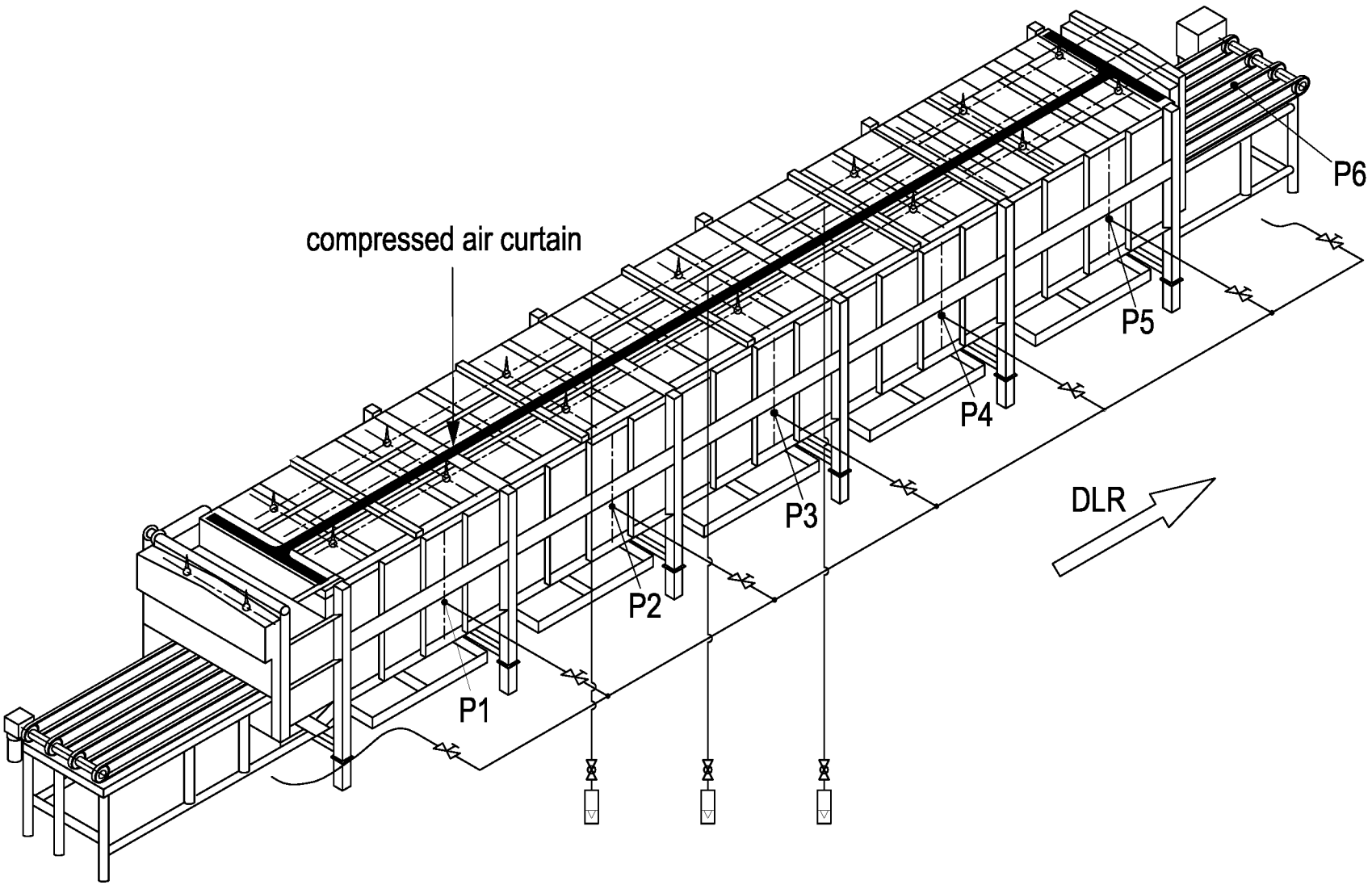
FIG. 7 shows a second continuous furnace for partial dew point control over the blank or component width, according to the invention.

One (or more) separation(s) in the longitudinal direction can also be carried out in the continuous furnace in order to enable dew point control in the furnace in certain areas. A compressed air curtain can preferably be used as a separating medium. Such a continuous furnace is shown in FIG. 7.

The furnace is equipped with a compressor, expansion tank, air dryer and control unit of the feed. The supply air for the air is supplied via electrically controlled valves. The dry or humidified air is supplied via six pairs of supply air lances, each of which is controlled separately (air volume/pressure/dew point).

Measurements are monitored by three to six dew point measuring instruments, the measuring instruments can also carry out counter-rotating measurements, wherein different measuring instruments carry out the measurement at the different measuring points (e.g. measuring instrument 2 at measuring point 5) so that a permanent measurement compensation can take place. It is also advantageous to calibrate all dew point measuring instruments at one measuring point by switching them.

Five measuring points in the furnace and one outside ensure permanent monitoring of the dew point in the furnace. Two measuring instruments measure the atmosphere in the furnace, one measuring instrument measures the air atmosphere of the hall air, should the dew point atmosphere in the hall change, the system can automatically adjust to the dew point in the furnace. The required settings for each component are made by an operator at the operating station.

With the supply of air humidified from one side and dry air from the other side, two atmospheres can be created in the furnace and different oxide layers can be set depending on the component specifications. The separation of the two atmospheres is ensured by a compressed air curtain in the middle, the compressed air for the curtain is set 0.5 bar higher than the supply air of the humidified air/dry air, thus creating a kind of artificial curtain that separates the two atmospheres from each other.

This allows, for example, for the heating of welded blanks (Tailor Welded Blanks—TWB) or flexibly rolled blanks (Tailor Rolled Blanks—TRB), the dew point to be controlled precisely for the thicker side of the blanks, so that the heating rate is accelerated for the thicker side and slowed down for the thinner side, so that both sides of the blanks reach the austenitization point Ac3 almost at the same time (i.e. at the same passage time).

In addition, further compressed air curtains can be provided in the furnace inlet and/or outlet area, which can protect the furnace atmosphere from undesired turbulence and other external influences on the atmosphere.

Such compressed air curtains can of course also be used with a continuous furnace as shown in FIG. 1.

It is understood that the control can also be separately controlled for the different zones on the left and right, i.e. for each individual air lance, if a targeted influence is necessary.

In addition, several compressed air curtains, e.g. 2 or 3, can be provided in the longitudinal direction of the continuous furnace if, for example, components with more than two areas or grades of different thickness are to be fed into the process.

The invention claimed is:

1. A method for heating a sheet metal blank or a formed sheet metal component above the austenitizing temperature, comprising:

setting a dew point of a furnace atmosphere from −15° C. to 15° C. in order to control a formation of a loosely adhering oxide skin on the sheet metal blank or component coated with a metallic corrosion protection layer or an uncoated sheet metal blank or component; and measuring an emissivity of the sheet metal blank or component during a furnace passage and controlling the dew point as a function of the emissivity in such a way that a target emissivity of the sheet metal is achieved.

2. The method according to claim 1, comprising setting the dew point of the furnace atmosphere higher, between 0° C. and 10° C., wherein, after leaving the furnace, the sheet metal blank or formed sheet metal component has a uniform distribution of zinc oxide with proportions of manganese oxides or mixed zinc-manganese oxides, with the sheet metal blank or formed sheet metal component having a greenish appearance.

3. The method according to claim 1, comprising using a plurality of lances arranged down a length of a furnace passage direction to blow dried air over a length of the furnace in the furnace passage direction.

4. The method according to claim 3, wherein a same amount of dried air is injected via the lances at each injection point.

5. The method according to claim 4, wherein at each of the injection points, air is injected via the lances which has a same degree of drying in each case.

6. The method according to claim 1, comprising setting the dew point of the furnace atmosphere to −8° C. to +8° C.

7. The method according to claim 1, comprising setting the dew point of the furnace atmosphere to −5° C. to +5° C.

8. The method according to claim 3, wherein a different amount of dried air is injected via the lances at each injection point.

9. The method according to claim 8, wherein at each of the injection points, air is injected via the lances which has a different degree of drying in each case.

* * * * *